US010556604B2

(12) United States Patent
Plant

(10) Patent No.: US 10,556,604 B2
(45) Date of Patent: Feb. 11, 2020

(54) RAILROAD BLOCK/GRADE CROSSING WARNING SYSTEM

(71) Applicant: Fermi Research Alliance, LLC, Batavia, IL (US)

(72) Inventor: Derek L. Plant, Batavia, IL (US)

(73) Assignee: FERMI RESEARCH ALLIANCE, LLC, Batavia, IL (US)

( * ) Notice: Subject to any disclaimer, the term of this patent is extended or adjusted under 35 U.S.C. 154(b) by 252 days.

(21) Appl. No.: 15/485,411

(22) Filed: Apr. 12, 2017

(65) Prior Publication Data

US 2017/0291620 A1 Oct. 12, 2017

Related U.S. Application Data

(60) Provisional application No. 62/321,253, filed on Apr. 12, 2016.

(51) Int. Cl.
*B61L 1/18* (2006.01)

(52) U.S. Cl.
CPC ..... *B61L 1/185* (2013.01)

(58) Field of Classification Search
CPC ..... B61L 1/00; B61L 1/18; B61L 1/185
See application file for complete search history.

(56) References Cited

U.S. PATENT DOCUMENTS 2,124,629 A * 7/1938 O'Hagan ..... B61L 1/185 246/256
3,387,064 A 6/1968 Joy et al.
3,825,915 A * 7/1974 Dow ..... G01R 31/02 246/169 R
4,581,700 A 4/1986 Farnham et al.
5,417,388 A 5/1995 Stillwell
5,470,034 A 11/1995 Reeves
5,825,283 A * 10/1998 Camhi ..... B60R 25/102 340/438
6,102,340 A 8/2000 Peek et al.
6,112,142 A 8/2000 Shockley et al.
6,113,037 A * 9/2000 Pace ..... B61L 23/06 246/124
6,179,252 B1 1/2001 Roop et al.
6,218,961 B1 4/2001 Gross et al.
6,371,416 B1 4/2002 Hawthorne
6,609,049 B1 8/2003 Kane et al.
(Continued)

FOREIGN PATENT DOCUMENTS

WO 2016054500 A1 4/2016

OTHER PUBLICATIONS

Cummings, B., Metro-North to add safety measures, Connecticut Post, Jun. 22, 2013, 4 pages, http://www.ctpost.com/local/article/metro-north-to-add-safety-measures-4614386.php.
(Continued)

*Primary Examiner* — Robert J McCarry, Jr.
(74) *Attorney, Agent, or Firm* — Loza & Loza LLP; Kevin L. Soules

(57) ABSTRACT

A train safety system comprises a cable connected to at least two conducting contacts, an electrical load between said two conducting magnetic contacts, and a DC track circuit associated with railroad tracks wherein the at least two conducting plates can be connected to each of the railroad rails in order to shunt the DC track circuit and alert oncoming trains of fouling of the tracks or crossing ahead.

20 Claims, 6 Drawing Sheets

(56) References Cited

U.S. PATENT DOCUMENTS

| | | | | |
|---|---|---|---|---|
| 9,434,397 | B2 | 9/2016 | Chung et al. | |
| 2001/0050324 | A1* | 12/2001 | Greene, Jr. | B61L 29/24 246/284 |
| 2016/0096538 | A1* | 4/2016 | Bartek | B61L 23/00 246/28 R |

OTHER PUBLICATIONS

Erico Rail Base Track Circuit Single Shunt, T-Handle, SBB2721VS72, Pentair Electrical & Fastening Solutions, printed Jun. 9, 2017, 2 pages, https://www.erico.com/part.asp?part=SBB2721VS72.

Erico Rail Head Track Circuit Dual Shunt, T-Handle, SBB2721G, Pentair Electrical & Fastening Solutions, printed Jun. 9, 2017, 2 pages, https://www.erico.com/part.asp?part=SBB2721G.

Safe Track Shunt, YouTube, Uploaded Oct. 1, 2007, https://www.youtube.com/watch?v=WB7BQaNgWMA.

Track Circuit Shunt, Safetrack shop, Safety System, Railway, printed Jun. 9, 2017, 2 pages, http://www.safetrack.se/en/products/safetrack-ab-web-shop/route/catalog/controller/category/type/view/shopid/88/.

Scott, S. et al., Rail Shunt Connection Test System, National University Rail Center, 2 pages, http://www.nurailcenter.org/tech-and-pub/doc/briefs/NURail%20Brief%20Rail%20shunt.pdf.

* cited by examiner

RAILROAD BLOCK/GRADE CROSSING WARNING SYSTEM

CROSS-REFERENCE TO RELATED APPLICATIONS

This patent application claims the priority and benefit under 35 U.S.C. § 119(e) of U.S. Provisional Patent Application Ser. No. 62/321,253, filed Apr. 12, 2016, entitled "RAILROAD CROSSING GHOST TRAIN GENERATOR." U.S. Provisional Patent Application Ser. No. 62/321,253 is herein incorporated by reference in its entirety.

STATEMENT REGARDING FEDERALLY SPONSORED RESEARCH

The invention described in this patent application was made with Government support under the Fermi Research Alliance, LLC, Contract Number DE-AC02-07CH11359 awarded by the U.S. Department of Energy. The Government has certain rights in the invention.

TECHNICAL FIELD

The present embodiments are generally related to methods, systems, and apparatuses for trains, train tracks, and safety systems.

BACKGROUND

Railroads use equipment called "positive train control" (PTC) systems in various applications. The congressionally mandated PTC technology uses antennae on locomotives and sensors on tracks to monitor trains' precise locations and prevent collisions. Data shows that 15 passengers and 11 employees died in rail accidents in 2015. Far more people are killed by illegally crossing passenger tracks. 162 people were killed in 2015 alone attempting such illegal crossings.

There are two main PTC implementation methods currently being developed. The first makes use of fixed signaling infrastructure. The other makes use of wireless data radios spread out along the line to transmit dynamic information. The wireless implementation is generally cheaper, but is also much less reliable than using hard communications channels. Some systems operate with a hybrid technology that uses wireless links to update temporary speed restrictions or pass certain signals, with neither of these systems being critical for train operations.

Given the extraordinary danger associated with vehicles crossing train tracks, methods and systems for reducing the risk associated with train track crossing are needed.

SUMMARY

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole.

It is, therefore, one aspect of the disclosed embodiments to provide a safety system.

It is another aspect of the disclosed embodiments to provide a portable safety system.

It is another aspect of the disclosed embodiments to provide a capsule capable of interfacing with existing railroad traffic signal systems.

It is yet another aspect of the disclosed embodiments to provide an enhanced method and system for alerting trains to the presence of fouling on train tracks.

It is an additional aspect of the disclosed embodiments to provide an enhanced method, system, and apparatus that takes advantage of existing signal infrastructure to emulate the presence of a train in order to prevent collisions between trains and objects that are obstructing a train's path.

The aforementioned aspects and other objectives and advantages can now be achieved as described herein. In embodiments disclosed herein, a system, method, and apparatus for alerting trains to track fouling include a cable connected to at least two conducting contacts, an electrical load associated with the cable between the two conducting contacts, and a DC signal circuit associated with train tracks wherein the at least two conducting contacts can be connected to each of the train rails in order to shunt the DC signal circuit. Connecting the at least two conducting plates to train tracks serves to emulate the presence of a train by shunting the DC track circuit.

A magnet associated with each of the at least two conducting contacts is configured to ensure an operable connection between the train tracks and the conducting contacts. A conducting housing is formed around the magnet associated with, each of the at least two conducting contacts. The system and apparatus includes a tube configured to house the cable, the two conducting contacts, and the electrical load.

BRIEF DESCRIPTION OF THE FIGURES

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION

Figure 1:
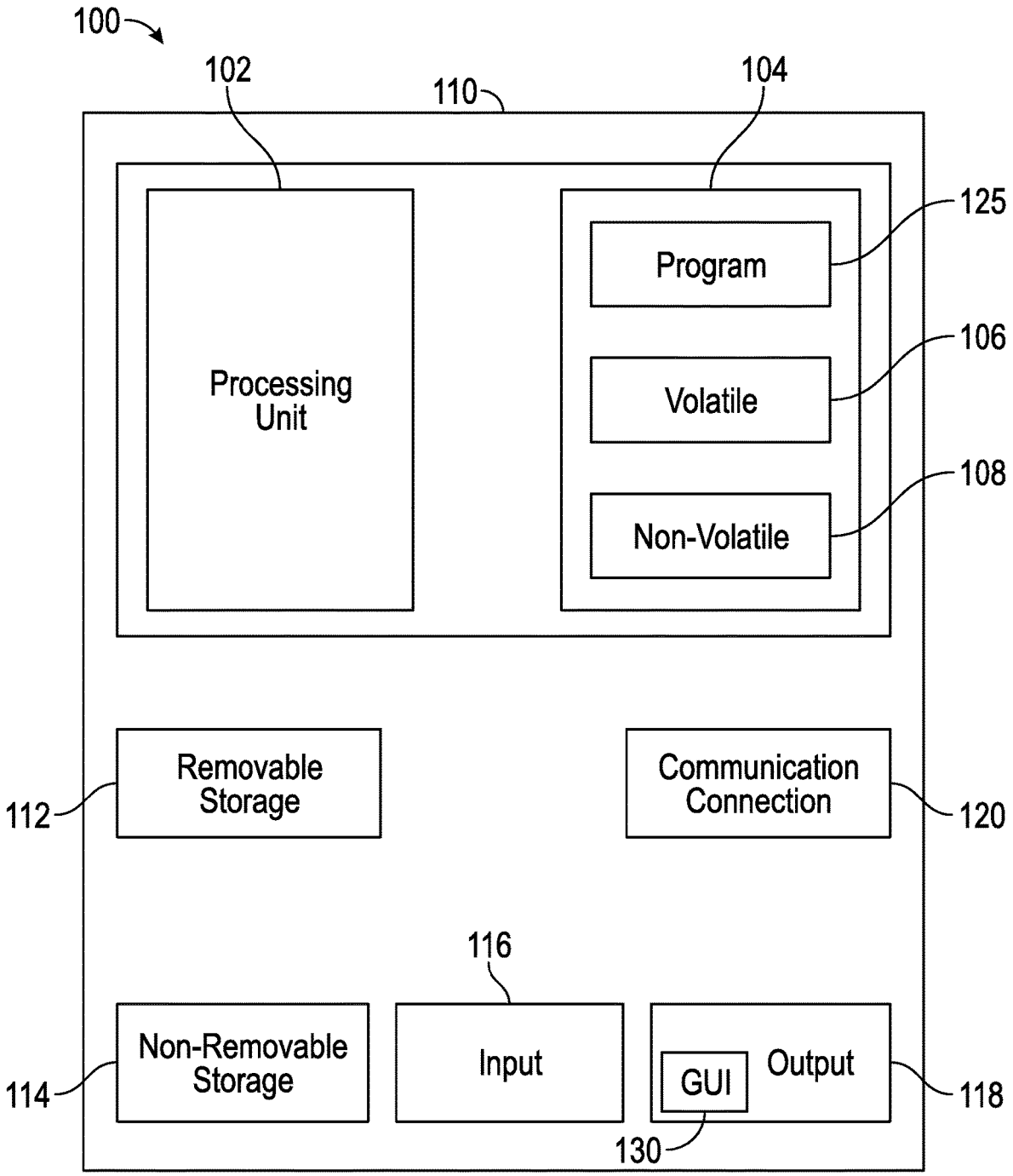
FIG. 1 depicts a block diagram of a computer system which is implemented in accordance with the disclosed embodiments.

The particular values and configurations discussed in the following non-limiting examples can be varied, and are cited merely to illustrate one or more embodiments and are not intended to limit the scope thereof.

Example embodiments will now be described more fully hereinafter with reference to the accompanying drawings, in which illustrative embodiments are shown. The embodiments disclosed herein can be embodied in many different forms and should not be construed as limited to the embodiments set forth herein; rather, these embodiments are provided so that this disclosure will be thorough and complete, and will fully convey the scope of the embodiments to those skilled in the art. Like numbers refer to like elements throughout.

The terminology used herein is for the purpose of describing particular embodiments only and is not intended to be limiting. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Throughout the specification and claims, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter include combinations of example embodiments in whole or in part.

In general, terminology may be understood at least in part from usage in context. For example, terms such as "and," "or," or "and/or" as used herein may include a variety of meanings that may depend at least in part upon the context in which such terms are used. Typically, "or" if used to associate a list, such as A, B, or C, is intended to mean A, B, and C, here used in the inclusive sense, as well as A, B, or C, here used in the exclusive sense. In addition, the term "one or more" as used herein, depending at leas part upon context, may be used to describe any feature, structure, or characteristic in a singular sense or may be used to describe combinations of features, structures, or characteristics in a plural sense. In addition, the term "based on" may be understood as not necessarily intended to convey an exclusive set of factors and may, instead, allow for existence of additional factors not necessarily expressly described, again, depending at least in part on context.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
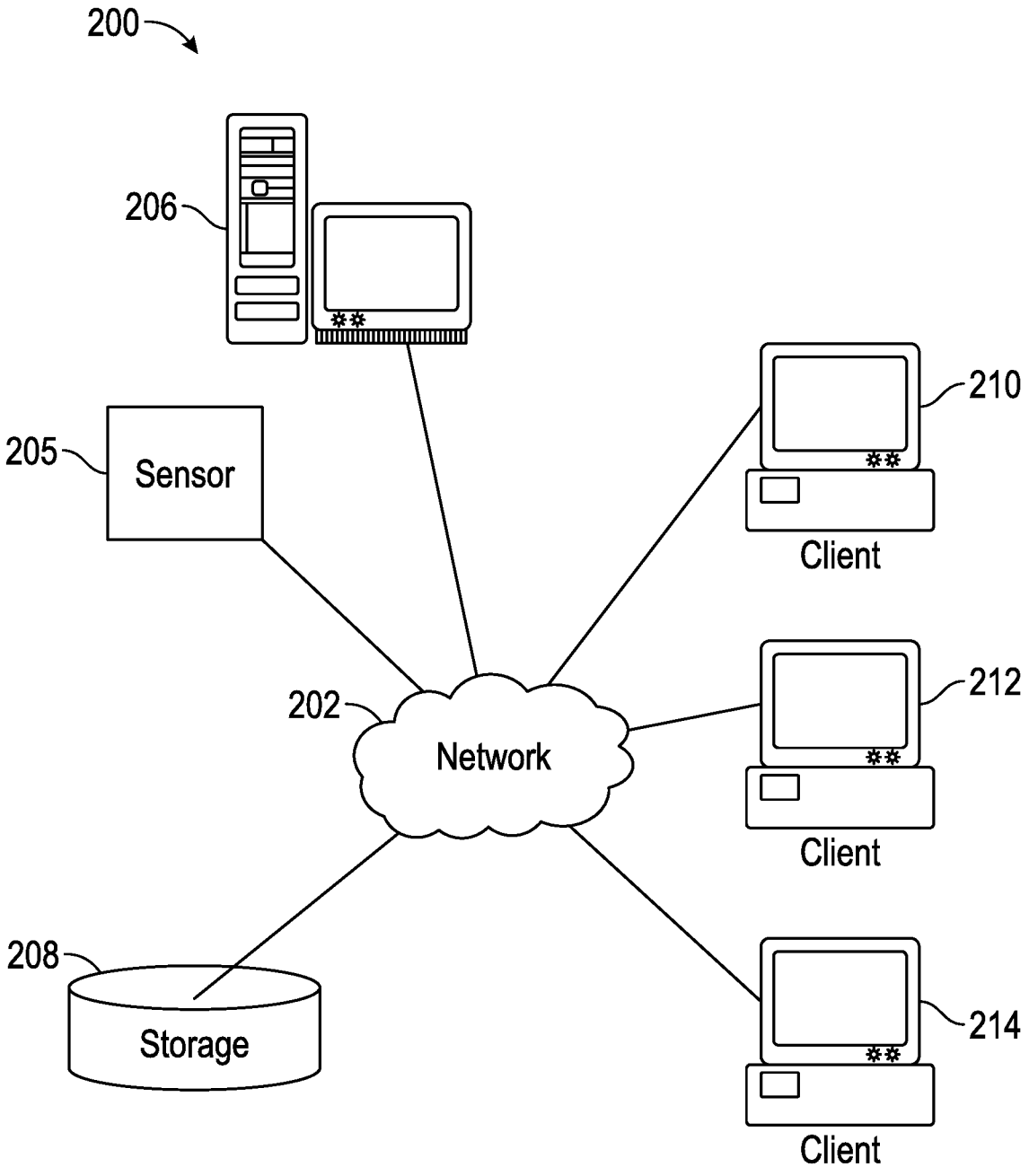
FIG. 2 depicts a graphical representation of a network of data-processing devices in which aspects of the present invention may be implemented.
Figure 3:
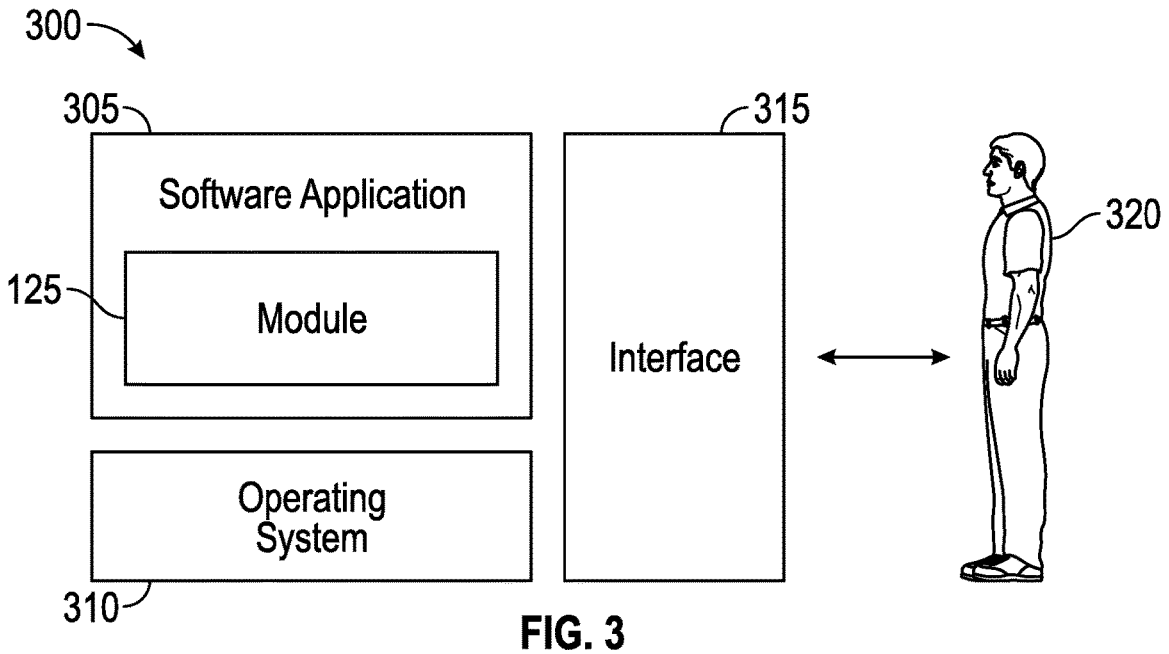
FIG. 3 depicts a computer software system for directing the operation of the data-processing system depicted in FIG. 1, in accordance with an example embodiment.

FIGS. 1-3 are provided as exemplary diagrams of data-processing environments in which embodiments of the present invention may be implemented. It should be appreciated that FIGS. 1-3 are only exemplary and are not intended to assert or imply any limitation with regard to the environments in which aspects or embodiments of the disclosed embodiments may be implemented. Many modifications to the depicted environments may be made without departing from the spirit and scope of the disclosed embodiments.

A block diagram of a computer system 100 that executes programming for implementing the methods and systems disclosed herein is shown in FIG. 1. A general computing device in the form of a computer 110 may include a processing unit 102, memory 104, removable storage 112, and non-removable storage 114. Memory 104 may include volatile memory 106 and non-volatile memory 108. Computer 110 may include or have access to a computing environment that includes a variety of transitory and non-transitory computer-readable media such as volatile memory 106 and non-volatile memory 108, removable storage 112 and non-removable storage 114. Computer storage includes, for example, random access memory (RAM), read only memory (ROM), erasable programmable read-only memory (EPROM) and electrically erasable programmable read-only memory (EEPROM), flash memory or other memory technologies, compact disc read-only memory (CD ROM), Digital Versatile Disks (DVD) or other optical disk storage, magnetic cassettes, magnetic tape, magnetic disk storage, or other magnetic storage devices, or any other medium capable of storing computer-readable instructions as well as data, including data comprising frames of video.

Computer 110 may include or have access to a computing environment that includes input 116, output 118, and a communication connection 120. The computer may operate in a networked environment using a communication connection to connect to one or more remote computers or devices. The remote computer may include a personal computer (PC), server, router, network PC, a peer device or other common network node, or the like. The remote device may include a sensor, photographic camera, video camera, tracking device, or the like. The communication connection may include a Local Area Network (LAN), a Wide Area Network (WAN), or other networks. This functionality is described in more fully in the description associated with FIG. 2 below.

Output 118 is most commonly provided as a computer monitor, but may include any computer output device. Output 118 may also include a data collection apparatus associated with computer system 100. In addition, input 116, which commonly includes a computer keyboard and/or pointing device such as a computer mouse, computer track pad, or the like allows a user to select and instruct computer system 100. A user interface can be provided using output 118 and input 116. Output 118 may function as a display for displaying data and information for a user and for interactively displaying a graphical user interface (GUI) 130.

Note that the term "GUI" generally refers to a type of environment that represents programs, files, options, and so forth by means of graphically displayed icons, menus and dialog boxes on a computer monitor screen. A user can interact with the GUI to select and activate such options by directly touching the screen and/or pointing and clicking with a user input device 116 such as, for example, a pointing device such as a mouse, and/or with a keyboard. A particular item can, function in the same manner to the user in all applications because the GUI provides standard software routines (e.g., module 125) to handle these elements and report the user's actions. The GUI can further be used to display the electronic service image frames as discussed below.

Computer-readable instructions, for example, program module 125, which can be representative of other modules described herein, are stored on a computer-readable medium and are executable by the processing unit 102 of computer 110. Program module 125 may include a computer application. A hard drive, CD-ROM, RAM, Flash Memory and a USB drive are just some examples of articles including a computer-readable medium, FIG. 2 depicts a graphical representation of a network of data-processing systems 200 in which aspects of the present invention may be implemented. Network data-processing system 200 is a network of computers in which embodiments of the present invention may be implemented. Note that the system 200 can be implemented in the context of a software module such as program module 125. The system 200 includes a network 202 in communication with one or more clients 210, 212, and 214. Network 202 is a medium that can be used to provide communications links between various devices and computers connected together within a networked data processing system such as computer system 100. Network 202 may include connections such as wired communication links, wireless communication links, or fiber optic cables. Network 202 can further communicate with one or more servers 206, one or more external devices such as a sensor 205 (for example, a detection sensor, a PTC system, etc.) and a memory storage unit such as, for example, memory or database 208.

In the depicted example, sensor 205 and server 206 connect to network 202 along with storage unit 208. In addition, clients 210, 212, and 214 connect to network 202. These clients 210, 212, and 214 may be, for example, personal computers or network computers. Computer system 100 depicted in FIG. 1 can be, for example, a client such as client 210, 212, and/or 214. Alternatively, clients 210, 212, and 214 may also be, for example, a photographic camera, video camera, tracking device, sensor, etc.

Computer system 100 can also be implemented as a server such as server 206, depending upon design considerations. In the depicted example, server 206 provides data such as boot files, operating system images, applications, and application updates to clients 210, 212, and 214, and/or to sensor 205. Clients 210, 212, and 214 are clients to server 206 in this example. Network data-processing system 200 may include additional servers, clients, and other devices not shown. Specifically, clients may connect to any member of a network of servers, which provide equivalent content.

In the depicted example, network data-processing system 200 is the Internet with network 202 representing a worldwide collection of networks and gateways that use the Transmission Control Protocol/Internet Protocol (TCP/IP) suite of protocols to communicate with one another. At the heart of the Internet is a backbone of high-speed data communication lines between major nodes or host computers consisting of thousands of commercial, government, educational, and other computer systems that route data and messages. Of course, network data-processing system 200 may also be implemented as a number of different types of networks such as, for example, an intranet, a local area network (LAN), or a wide area network (WAN). FIGS. 1 and 2 are intended as examples and not as architectural limitations for different embodiments of the present invention.

FIG. 3 illustrates a computer software system 300, which may be employed for directing the operation of the data-processing systems such as computer system 100 depicted in FIG. 1. Software application 305, may be stored in memory 104, on removable storage 112, or on non-removable storage 114 shown in FIG. 1, and generally includes and/or is associated with a kernel or operating system 310 and a shell or interface 315. One or more application programs, such as module(s) 125, may be "loaded" (i.e., transferred from removable storage 112 into the memory 104) for execution by the data-processing system 100. The data-processing system 100 can receive user commands and data through user interface 315, which can include input 116 and output 118, accessible by a user 320. These inputs may then be acted upon by the computer system 100 in accordance with instructions from operating system 310 and/or software application 305 and any, software module(s) 125 thereof.

Generally, program modules (e.g., module 125) can, include, but are not limited to, routines, subroutines, software applications, programs, objects, components, data structures, etc., that perform particular tasks or implement particular abstract data types and instructions. Moreover, those skilled in the art will appreciate that the disclosed method and system may be practiced with other computer system configurations such as, for example, hand-held devices, multi-processor systems, data networks, microprocessor-based or programmable consumer electronics, networked personal computers, minicomputers, mainframe computers, servers, and the like.

Note that the term module as utilized herein may refer to a collection of routines and data structures that perform a particular task or implements a particular abstract data type. Modules may be composed of two parts: an interface, which lists the constants, data types, variable, and routines that can be accessed by other modules or routines; and an implementation, which is typically private (accessible only to that module) and which includes source code that actually implements the routines in the module. The term module may also simply refer to an application such as a computer program designed to assist in the performance of a specific task such as word processing, accounting, inventory management, etc.

The interface 315 (e.g., a graphical user interface 130) can serve to display results, whereupon a user 320 may supply additional inputs or terminate a particular session. In some embodiments, operating system 310 and GUI 130 can be implemented in the context of a "windows" system. It can be appreciated, of course, that other types of systems are possible. For example, rather than a traditional "windows" system, other operation systems such as, for example, a real time operating system (RTOS) more commonly employed in wireless systems may also be employed with respect to operating system 310 and interface 315. The software application 305 can include, for example, module(s) 125, which can include instructions for carrying out steps or logical operations such as those shown and described herein.

The following description is presented with respect to embodiments of the present invention, which can be embodied in the context of a data-processing system such as computer system 100, in conjunction with program module 125, and data-processing system 200 and network 202 depicted in FIGS. 1-2. The present invention, however, is not limited to any particular application or any particular environment. Instead, those skilled in the art will find that the system and method of the present invention may be advantageously applied to a variety of system and application software including database management systems, word processors, and the like. Moreover, the present invention may be embodied on a variety of different platforms including Macintosh, UNIX, LINUX, and the like. Therefore, the descriptions of the exemplary embodiments, which follow, are for purposes of illustration and not considered a limitation.

Figure 4:
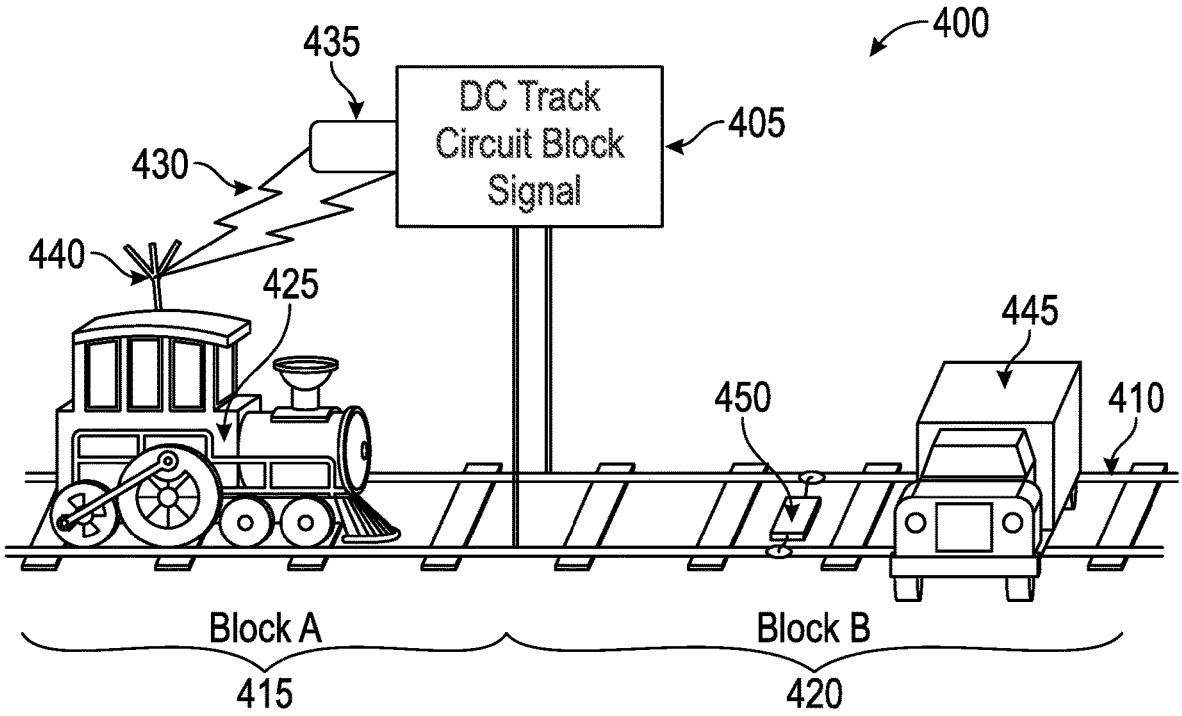
FIG. 4 depicts a safety alert system in accordance with the disclosed embodiments.

The embodiments disclosed herein provide emergency monitoring and reporting systems and methods associated with trains and train tracks. FIG. 4 illustrates an embodiment of a railroad block/warning system 400. In general, a DC block signal system 405 can be connected to a railroad 410. It should be appreciated that AC components can be integrated in, or associated with, the DC block signal system, and are therefore included in embodiments related to the DC block signal system 405. The DC block signal system 405 can be further connected to, or otherwise associated with, a PTC system. The railroad 410 can be identified as a series of rail segments known as blocks. FIG. 4 illustrates two such blocks, block A 415 and block B 420. In FIG. 4, train 425 is traveling along block A 415. In general, a railway system can include any number of rail blocks and FIG. 4 illustrates a limited number of blocks for illustrative purposes only.

The DC block signal system 405 operates by detecting the presence of a train in a given rail block. The metal wheels of the train complete a circuit between the rails of the track and the PTC system. Thus, when a train enters a block, the PTC system automatically recognizes that the block is occupied by a train via the completion of the circuit. When the train exits the block, the circuit connection is broken and the PTC system is updated to show the block as unoccupied.

As a train 425 travels along railroad 410, DC block signal system 405 serves as a safety measure. On a very basic level, the PTC system provides a green or safe indicator if the next rail block (in this case block B 420) is passable, and a red or caution indicator if there is another train in the block, making travel along the next rail block unsafe. The DC block signal system 405 can communicate with train 425 via wired or wireless communication. As illustrated in FIG. 4, a wireless signal 430 is provided from a transmitter 435 associated with the PTC system to a receiver 440 associated with the train 425. Other means of communication are also possible.

Figure 5:
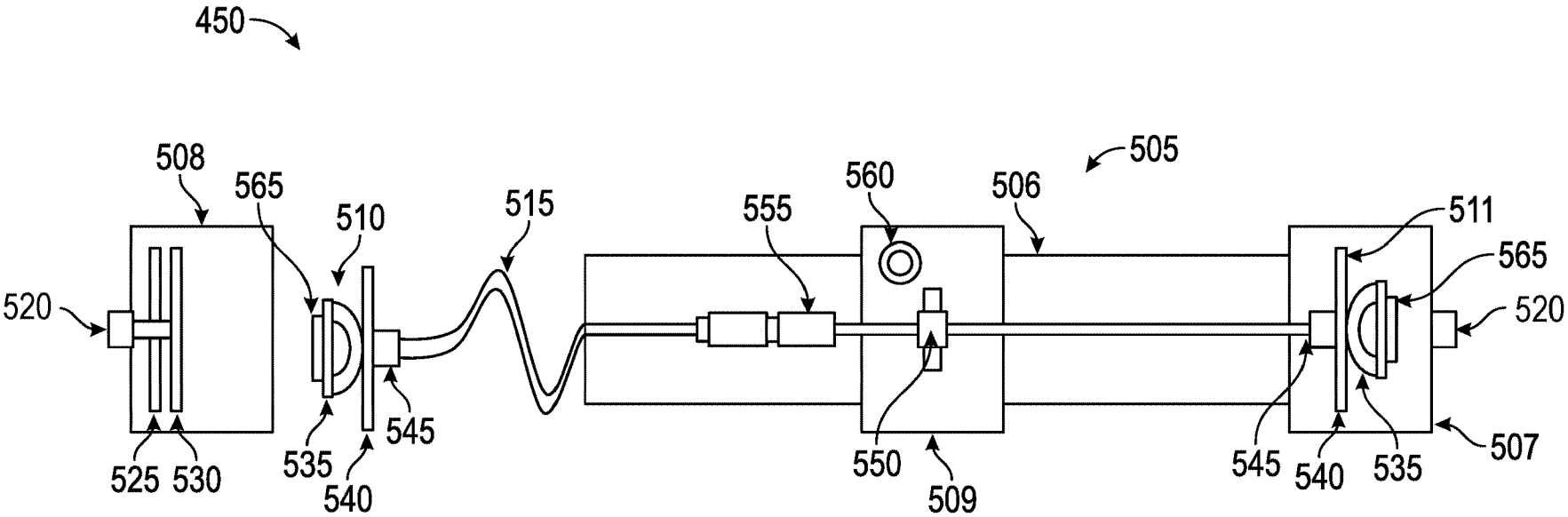
FIG. 5 depicts a safety capsule for deployment on train tracks in accordance with the disclosed embodiments.

FIG. 4 further illustrates the dangerous situation where a vehicle 445 has become stranded along the train track 410 in rail block B 420. This presents a serious hazard for both the train 425 and the occupants of the vehicle 445, along with others that may be involved in attempting to remove the vehicle 445. The PTC system is designed to operate by indicating when another train is present in the block. However, because the stranded vehicle 445 does not complete the PTC circuit, the vehicle 445 is essentially invisible to the DC block signal system 405. As such, the DC block signal system 405 does not register a red condition even though it is not safe to proceed on to block B 420 (because of stranded vehicle 425). However, safety system 450 can be deployed, as illustrated in FIG. 4, to shunt the DC track circuit which will, in turn, change block signals to a red condition and trigger DC block signal system 405. Safety system 450 is further detailed din FIG. 5.

The safety system 450 includes a self-contained portable capsule 505 containing a very low resistance electrical load 515 that can be deployed across railroad rails 410. As often described in simple DC circuits, the low resistance load 515 may also be described as a shunt, conductor, switch, breaker, dummy load, wire, cable, current path, electron path, path of least resistance, jumper, inductor, resistor, ground loop, or ground circuit. These may vary impedance from embodiment to embodiment. Resistance of 0.04 Ohm or less is preferable, but other resistances may be alternatively employed according to design considerations. The electrical load 515 can comprise a memory coil load and may contain different metals to achieve a desired conductive value.

The portable capsule 505 includes a body 506 and end caps 507 and 508. The body 506 can further comprise two pieces joined by joint 509. The capsule 505 can be comprised of lightweight hard materials. In an embodiment, the capsule 505 design is cylindrical and constructed of PVC. More sophisticated models may be constructed from steel, stainless steel, polyester resin, cardboard, carbon fiber, fiberglass, or other polycarbonate materials. The portable capsule 505 can be covered with reflective material and can be brightly colored.

The end caps 507 and 508 can be fitted with a nut and screw assembly 520 that holds a washer assembly 525 and magnetic keeper 530 that holds the end connection 510 in the end of cap 508 before deployment. It should be appreciated that a substantially identical nut and screw assembly 520 can hold a washer assembly 525 and magnetic keeper 530 in the end cap 507.

Prior to deployment, each magnet 535 will adhere to its "keeper" mounted inside of its respective end cap 510 or 511 while stowed. This will allow adequate magnetic flux return in order to contain stray magnetic fields that may otherwise interfere with navigational aids, or attract unwanted metal objects to the system when not in use. The keeper 530 can be electrically insulated to the magnet 535 to prevent cathodic corrosion due to dissimilar metals. Insulating tape or other insulating materials may be used for this purpose. The thickness of the insulator will be such as to reduce the force required to disengage the magnet from the cap keeper 530. The cap keeper 530 design can also provide quick access to each magnet 535 for deployment.

In certain embodiments, connection 510 and connection 511 can be attached to the ends of load 515. The connection 510 includes magnet 535 enclosed in a housing. The housing can be formed of stainless steel or other similar conductor. The material encapsulating the magnets 535 is preferably corrosion resistant. Nickel or gold plating or other conductive, corrosion resistant plating may also be added to the magnets 535 to assure reliable contact. A washer 540 and machine screw 545 arrangement can be used to connect the cable 515 to the connection 510. Connection 511 includes a substantially identical configuration including a magnet 535 enclosed in a housing and connected to cable 515 with a washer 540 and machine screw 545 arrangement. The low resistance load is robust and mechanically fastened to the magnet in such a manner as to allow the magnet to be successfully removed from the rail by pulling the load.

A cable retractor 550 can be provided in the center of the portable capsule 505 and can serve to retract cable 515 toward the center point of the capsule 505. The cable 515 can further comprise memory coil such that the cable 515 is naturally biased toward coiling in the center of the capsule. The conductive load can be embodied as a coiled cable that, when stretched, can easily reach 5 feet, but preferably reaches at least 8 feet. Other lengths may alternatively be used according to design considerations. The cable 515 may be insulated. The cable 515 can be stowed in a tube or container that is air tight to prevent moisture induced corrosion.

In other embodiments, a conductor load can be provided that is wound, coiled, or otherwise stored, stowed, or retracted onto a spool, rod, sphere, ball, cylinder, spiral, or otherwise mechanically passive, hand wound, hand cranked, or mechanically sprung or mechanically loaded with springs or pneumatically deployed. In certain embodiments, hooks, wedges, pegs, holes, threaded holes, gaps, clamps, suction cups, expansion mechanisms, contraction mechanisms, clasps, surfactants, liquefiers, or other mechanisms in order to electrically, magnetically, mechanically, or otherwise induce railroad signals to display occupied status to railroad block signals.

In certain embodiments, the impedance of the system may vary over time (per second) and may contain batteries 555 that will energize the track circuit with either direct current or alternating current in frequencies from near the DC to the UHF radio frequency spectrum. This includes HF, VHF, and UHF, respectively, in order to trigger railroad signaling or controlling devices such as existing locomotive cab signals block signals, positive train control infrastructure, radio, GPS, or developing railroad traffic control devices.

Batteries 555 can also be used to supply power to strobe light 560 that can be formed on the exterior of the capsule 505. Strobe light 560 provides a visual warning signal and may further provide light to guide installation of the system on a track when lighting conditions so require. The strobe lamp can automatically begin flashing seconds after successful deployment. The container tube can, also contain a power source and wireless technology that can be integrated with existing mobile networks and data logging that can facilitate document deployment, as well as give authorities location confirmation. Radio wave triangulation or GPS can be included in certain embodiments. Other embodiments may use wireless technology, cellular technology, or an onboard transceiver to automatically signal for, or data log authorities upon deployment to aid near miss, accident, or safety investigation, or to discourage misuses of the device.

Figure 6:
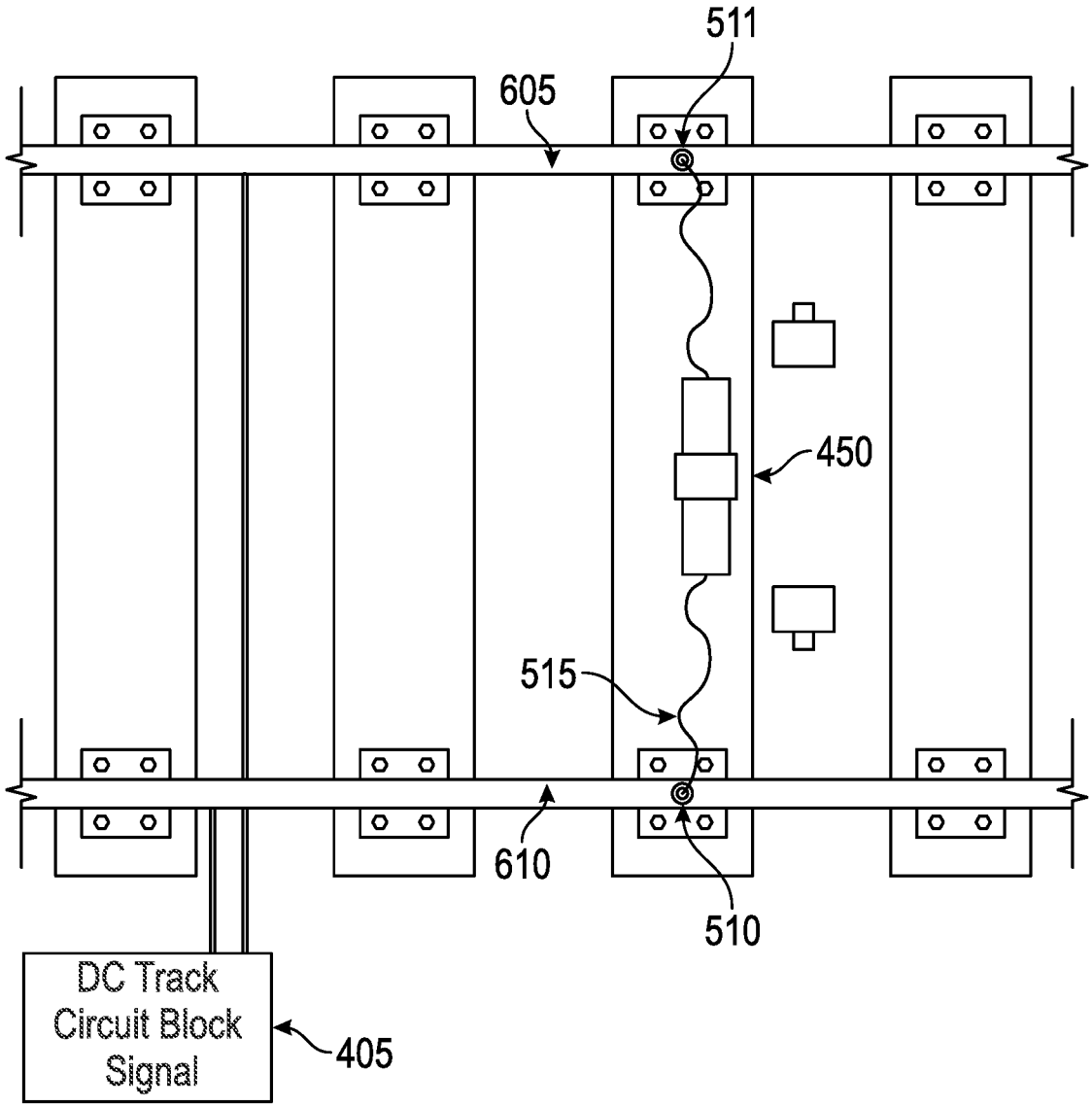
FIG. 6 depicts deployment of a safety capsule on train tracks in accordance with disclosed embodiments.

FIG. 6 illustrates deployment of a safety system 450 in accordance with the embodiments disclosed herein. As illustrated, the end caps of safety system 450 can be removed from the capsule 505 and the connections 510 and 511 can be removed from the keeper 530. The connection 510 can be disposed on one train track 610 and the other connection 511 can be disposed on the other train track 605.

Strong Neodymium (N42 4 k Tesla or stronger) magnets can be employed to serve as magnets 535 to assure adequate force, and therefore conductive contact, between the low resistance load and the rails 605 and 610. Other embodiments may employ other magnet types. These magnets may be encapsulated in stainless steel or other such conductive material.

The magnets can be formed with geometry that coincides with the geometry of the physical profile of the top, sides, or other conductive areas of railroad rails 605 and 610 in order to maximize conductivity and/or mechanical friction of, and to, the low resistance load. In other embodiments, the magnets can have multiple contact points or tripod style magnets can be used to maximize conductivity and friction of, and to, the low resistance load. The magnets can have a textured surface or material formed thereon to maximize conductance and/or mechanical friction to the railroad system.

In certain embodiment, the contacts 510 and 511 can comprise contacts that are parabolic, spherical, can be brushes similar to commutators in electrical motors, or brushes utilizing multiple strand wire. The intended contact point from the device may include the grade crossing structure, tie plates, track spikes, clasps, bolts, screws, holes, track clamps, etc.

In other embodiments, conductive liquids, chemically reactive substances, conductive gels, conductive pastes, conductive adhesives, ampoules of such materials both automatically, or manually deployed, can be used to facilitate the necessary conductance, resistance, reactance, impedance, electrical or electromagnetic energy imparted to, or by the device in order to bring about a change in state to railroad signaling or railroad traffic controlling devices. Such conductive liquids may be provided inside the capsule 505 in separate packaging or can be applied from an external source.

In still other embodiments, the contacts 510 and 511 can utilize coil springs, metallic screen leaf springs, or other flexible conductive media between the low resistance load and the rail to facilitate contact and/or friction. Reactive or corrosive liquids, corrosive pastes, corrosive gels, or corrosive adhesive can facilitate contact and friction between the rail and contacts 510 and 511.

In another embodiment, the safety system 450 can be initially deployed using a liquid that can solidify after deployment. In such embodiments, a compressed spray similar to "silly string" or "great stuff" can be provided in capsule 505 and is utilized, provided the medium was "doped" adequately or otherwise conductive enough to trigger current from one rail to the other, on existing or developing railroad signaling devices.

In such embodiments, the system can use power from batteries 555, or alternatively generators, or parasitic use of a vehicle electrical systems via a cabling harness connected to the load (or contacts) on one end and the vehicle battery on the other, in order to weld themselves to the rails to facilitate contact. Existing spot welding alloys or material may be utilized in such embodiments. Chemical reactions between dissimilar metals or metals and liquids may also be used to facilitate mechanical or electrical continuity in order to manipulate existing or developing railroad signaling or vehicle controlling devices.

Some embodiments may contain ink or dye cartridges 565 similar to those used in fire alarms or bank vaults that are crushed and dispense the dye to leave evidence of deployment should the crossing, become cleared before proper notification of authorities.

Embodiments can further employ O-ring seals between caps 507 and 508 and the capsule body 506, respectively, to minimize moisture contamination.

It should be understood that with the embodiments disclosed above describe the use of magnets for contacts 510 and 511, in other embodiments clamps or clips can be used instead of, or in addition to, magnets. In other embodiments, circuitry that will change the resistance of the load periodically to cause the red state of signals to become intermittent to specifically indicate the system is being used (as opposed to the presence of the train causing the state). For example, embodiments can utilize modulating electrical current to trigger block signals upgraded specifically for emergency notification of track fouling. Embodiments can likewise utilize threaded caps, or push and twist end caps. Embodiments may utilize telescopic tubes to protect the load. Embodiments can allow for one time use utilizing electronic circuitry or mechanical timers. Embodiments can provide audio or visual alerts during deployment. Each device may be serialized and registered with the Department of Transportation. Further, some embodiments can also be used for training purposes and can contain a highly restive load that will not trigger block signals and will be uniquely marked as inoperable.

Figure 7:
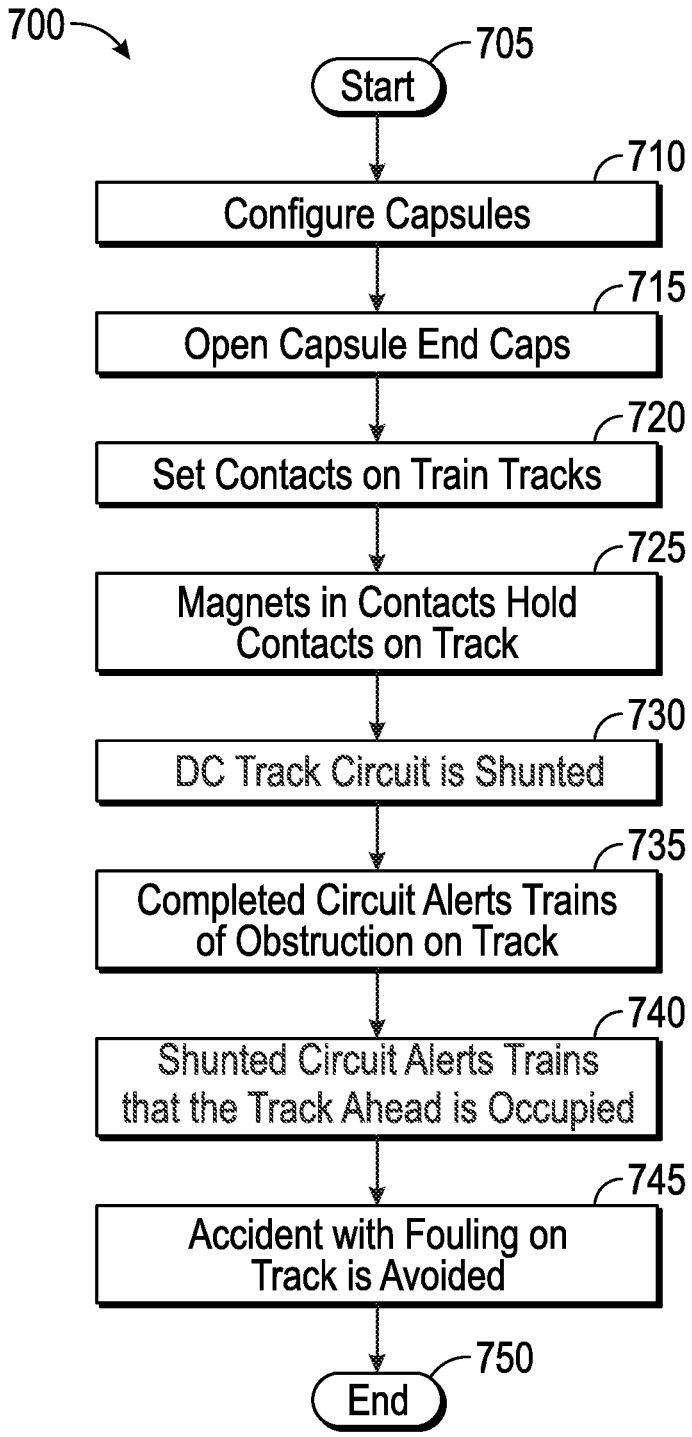
FIG. 7 depicts a flow chart illustrating steps of a method for alerting trains to obstructions in accordance with the disclosed embodiments.

A method 700 associated with warning approaching trains of a stranded vehicle, or other track fouling, on a train track is illustrated in FIG. 7. The method begins at block 705.

At block 710, an emergency capsule as described above can be configured and stored, for example, in a vehicle. At block 715, if a vehicle becomes stuck, or other such fouling is present on train tracks, the capsule can be opened by removing the end caps from the capsule and removing the magnetic connections from their keepers.

Contacts can be set on each of the two train tracks as shown at block 720. In certain embodiments, this can trigger visual signaling via a strobe lamp on the capsule as well as the transmission of electronic signals to PTC systems indicating the system has been deployed, the location of the deployment, and the time of the deployment. Further, dye packets optionally attached to the magnetic connections can be crushed leaving visual markings at the point of deployment.

The contacts are held in place on the tracks with magnets, or by other means, as illustrated at block 725. The contacts complete a warning circuit already in operation and associated with the train infrastructure as illustrated at block 730.

Most commonly such a system is a PTC system. The deployment of the system is intended to mimic the signal provided to approaching trains, of an oncoming train, or otherwise identifies a fouling on the train tracks as shown at block 735. At block 740, the alerted train accordingly reduces its speed and thereby avoids an accident with the fouling on the track as shown at block 745. The method ends at block 750.

The safety system 450 can thus simulate the continuity of locomotives or other rolling stock from rail to rail, shunting the existing DC track circuit, for example, associated with PTC systems, thereby mimicking the presence of a train at the location of deployment. The intention of the deployment of the system is to force adjoining railroad block signals into a condition indicating that a grade crossing is occupied (often referred to as a "red condition") in the event of a vehicle becoming stranded, or to otherwise prevent rail traffic from moving through a particular block. (Such as a semi, bus, farm tractor, or while maintenance work is being performed on tracks by railroad personnel etc.) This adjoining red signal condition can give a train's crew advanced notice of a grade crossing fouling and can reduce the probability of collision between trains and stranded vehicles or maintenance crews when deployed properly.

Deployment of this device can also initiate "stop signals" in the cabs of some modern locomotives utilizing existing wireless networks and computer systems that are synchronized with, already in place the track circuits taking advantage of existing PTC systems. The embodiments can generate "track occupied" or RED signal status to any area of rail, block, line, crossing, siding, easement, switch, yard, shunt, mainline, or otherwise, to intentionally minimize, reduce, or prevent collision between rail operated vehicles, track obstruction, or other hazards. These hazards include manmade and natural occurrences.

Vehicles that are prone to fouling grade crossings, rescue equipment, and law enforcement vehicles can be equipped with this device as deployment can nearly instantly warn a train's crew of trouble at a crossing. The system can be small and low maintenance. Embodiments can include a housing about 13" long, 4" in diameter that weighs about 5 lbs. Other sizes are possible.

Based on the foregoing, it can be appreciated that a number of embodiments, preferred and alternative, are disclosed herein. For example, in one embodiment, a system comprises a cable connected to at least two conducting contacts, an electrical load associated with the cable between the two conducting contacts, and a DC track signal circuit associated with railroad tracks wherein the at least two conducting contacts can be connected to each of the train rails in order to shunt the DC track circuit.

In an embodiment, the system further comprises a magnet associated with each of the at least two conducting contacts configured to ensure an operable connection between the railroad tracks and the conducting contacts. A conducting housing is formed around the magnet associated with each of the at least two conducting contacts.

In an embodiment, the system further comprises a tube configured to house the cable, the two conducting contacts, and the electrical load. The tube further comprises a first weatherproof end cap enclosing the first end of the tube and a second weatherproof end cap enclosing the second end of the tube. In an embodiment, the system also comprises a power source connected to the cable configured to supply power to a strobe light formed on an exterior of the tube.

In yet another embodiment, the system fu her comprises a dye packet affixed to each of the at least two conducting contacts.

In an embodiment of the system, the DC track signal circuit will turn at least one block signal at an obstructed railroad block to a red condition.

In an embodiment, the DC track signal circuit is associated with a positive train control system.

In another embodiment, an obstruction warning apparatus comprises a cable connected to at least two conducting contacts, an electrical load associated with the cable between the two conducting contacts, and a DC track signal circuit associated with railroad tracks wherein the at least two conducting contacts can be connected to each of the railroad tracks in order to complete the DC track signal circuit.

In an embodiment, the obstruction warning apparatus further comprises a magnet associated with each of the at least two conducting contacts configured to ensure an operable connection between the railroad tracks and the conducting contacts, and a conducting housing formed around the magnet associated with each of the at least two conducting contacts.

In an embodiment, the apparatus further includes a tube configured to house the cable, the two conducting contacts, and the electrical load. In an embodiment, the tube further comprises a first weatherproof end cap enclosing the first end of the tube and a second weatherproof end cap enclosing the second end of the tube. In another embodiment, the obstruction warning apparatus further comprises a power source connected to the cable configured to supply power to a strobe light formed on an exterior of the tube.

In an embodiment, the apparatus further comprises a dye packet affixed to each of the at least two conducting contacts.

In an embedment of the apparatus, the DC track signal circuit is associated with a positive train control system.

In yet another embodiment, a method for alerting trains to obstacles on train tracks comprises connecting at least two conducting plates to train tracks with a cable and emulating the presence of a train by completing a DC block signaling track circuit wherein the cable serves as an electrical load between the two conducting contacts.

In an embodiment, connecting at least two conducting plates to railroad tracks with a cable further comprises providing a magnet associated with each of the at least two conducting contacts to ensure operable connection between the railroad tracks and the conducting contacts.

The method further comprises housing the conducting plates and the cable in a tube and visually indicating an obstruction on the train tracks with a strobe light formed on an exterior of the tube and powered by a power source connected to the cable.

In an embodiment of the method, the DC block signaling track circuit is associated with a positive train control system.

It will be appreciated that variations of the above-disclosed and other features and functions, or alternatives thereof, may be desirably combined into many other different systems or applications. Also, it will be appreciated that various presently unforeseen or unanticipated alternatives, modifications, variations or improvements therein may be subsequently made by those skilled in the art which are also intended to be encompassed by the following claims.

What is claimed is:

1. A system comprising:

at least two conducting contacts;

a cable connected to said at least two conducting contacts;

an electrical load associated with said cable between said two conducting contacts, wherein said at least two conducting contacts can be connected to railroad tracks in order to shunt a track signal circuit associated with said railroad tracks; and a self-contained capsule configured to house said at least two conducting contacts, said cable, and said electrical load associated with said cable.

2. The system of claim 1 further comprising:

a magnet associated with each of said at least two conducting contacts configured to ensure an operable connection between said railroad tracks and said conducting contacts.

3. The system of claim 2 further comprising:

a magnetic keeper formed in said self-contained capsule, said magnetic keeper configured to contain a magnetic field created by said magnet associated with each of said at least two conducting contacts.

4. The system of claim 1 wherein said self-contained capsule further comprises:

a tube configured to house said cable, said two conducting contacts, and said electrical load.

5. The system of claim 4 wherein said self-contained capsule further comprises:

a first weatherproof end cap enclosing a first end of said tube; and a second weatherproof end cap enclosing a second end of said tube.

6. The system of 4 further comprising:

a power source configured to supply power to a strobe light formed on an exterior of said tube.

7. The system of claim 1 further comprising:

a dye packet affixed to at least one of said at least two conducting contacts.

8. The system of claim 1 wherein said track signal circuit will turn at least one block signal at an obstructed railroad block to a red condition.

9. The system of 1 wherein said track signal circuit is associated with a positive train control system.

10. An obstruction warning apparatus comprising:

at least two conducting contacts;

a cable connected to said at least two conducting contacts;

an electrical load associated with said cable between said two conducting contacts wherein said at least two conducting contacts can be connected to railroad tracks in order to complete a DC track signal circuit; and a self-contained capsule configured to house said at least two conducting contacts, said cable, and said electrical load associated with said cable.

11. The obstruction warning apparatus of claim 10 further comprising:

a magnet associated with each of said at least two conducting contacts configured to ensure an operable connection between said railroad tracks and said conducting contacts; and a magnetic keeper formed in said self-contained capsule, said magnetic keeper configured to contain a magnetic field created by said magnet associated with each of said at least two conducting contacts.

12. The obstruction warning apparatus of claim 10 wherein said self-contained capsule further comprises:

a tube configured to house said cable, said two conducting contacts, and said electrical load.

13. The obstruction warning apparatus of claim 12 wherein said self-contained capsule further comprises:

a first weatherproof end cap enclosing a first end of said tube; and a second weatherproof end cap enclosing a second end of said tube.

14. The obstruction warning apparatus of claim 13 further comprising:

a power source housed in said self-contained capsule, configured to supply power to a strobe light formed on an exterior of said tube.

15. The obstruction warning apparatus of claim 10 further comprising:

a dye packet affixed to at least one of said at least two conducting contacts.

16. The obstruction warning apparatus of claim 10 wherein said DC track signal circuit is associated with a positive train control system.

17. A method for alerting trains to hazards comprising:

housing at least two conducting contacts, a cable, and an electrical load associated with said cable in a self-contained capsule;

connecting at least two conducting contacts to train tracks with said cable; and emulating the presence of a train by completing a DC block signaling track circuit wherein said cable serves as said electrical load between said two conducting contacts.

18. The method of claim 17 wherein connecting at least two conducting contacts to railroad tracks with a cable further comprises:

providing a magnet associated with each of said at least two conducting contacts to ensure operable connection between said railroad tracks and said conducting contacts.

19. The method of claim 18 further comprising:

containing a magnetic field associated with said magnet with a magnetic keeper formed in said self-contained capsule.

20. The method of 17 wherein said DC block signaling track circuit is associated with a positive train control system.

* * * * *